US008273001B2

(12) United States Patent
Karecki et al.

(10) Patent No.: US 8,273,001 B2
(45) **Date of Patent: *Sep. 25, 2012**

(54) EXERCISE KIT, APPAREL ITEM AND METHOD OF USING SAME

(76) Inventors: Linda Karecki, Solana Beach, CA (US); Michael M. Potempa, Freeport, IL (US); Brian Potempa, Freeport, IL (US)

( * ) Notice: Subject to any disclaimer, the term of this patent is extended or adjusted under 35 U.S.C. 154(b) by 348 days.

This patent is subject to a terminal disclaimer.

(21) Appl. No.: 12/637,693

(22) Filed: Dec. 14, 2009

(65) Prior Publication Data

US 2011/0143892 A1 Jun. 16, 2011

(51) Int. Cl.
*A63B 21/045* (2006.01)
*A63B 21/008* (2006.01)
*A63B 23/04* (2006.01)

(52) U.S. Cl. ..... 482/124; 482/51; 482/92; 482/112; 482/127; 602/6; 602/13; 602/23; 2/22; 450/146

(58) Field of Classification Search ..... 482/78, 482/92, 105, 111, 112, 121, 122, 124, 127, 482/131, 908, 51; 602/6, 13, 23; 2/22; 450/146
See application file for complete search history.

(56) References Cited

U.S. PATENT DOCUMENTS

| | | | | |
|---|---|---|---|---|
| 3,559,654 A | | 2/1971 | Pope, Jr. | |
| 3,759,510 A | | 9/1973 | Jackson, Jr. | |
| 4,384,369 A | | 5/1983 | Prince | |
| 5,033,123 A | | 7/1991 | Audet | |
| 5,109,546 A | | 5/1992 | Dicker | |
| 5,176,600 A | * | 1/1993 | Wilkinson | 482/124 |
| 5,465,428 A | | 11/1995 | Earl | |
| 5,606,745 A | * | 3/1997 | Gray | 2/69 |
| 5,659,898 A | * | 8/1997 | Bell, Jr. | 2/69 |
| 5,708,976 A | | 1/1998 | Dicker | |
| 5,842,859 A | | 12/1998 | Palacci | |
| 5,875,491 A | | 3/1999 | Wilkinson | |
| 5,897,423 A | | 4/1999 | Rosenberg | |
| 5,921,945 A | | 7/1999 | Gray | |
| 5,978,965 A | | 11/1999 | Summers | |
| 6,258,014 B1 | | 7/2001 | Karecki | |
| 6,520,893 B2 | | 2/2003 | Bray | |
| 6,656,097 B2 | | 12/2003 | Karecki | |
| 7,077,794 B1 | | 7/2006 | Bray | |
| 7,152,625 B2 | | 12/2006 | Marvin | |
| 7,744,511 B2 | * | 6/2010 | Grigoriev et al. | 482/124 |
| 2007/0271668 A1 | * | 11/2007 | Pape | 2/69 |

OTHER PUBLICATIONS

Power-Systems.com at http://www.power-systems.com providing a weighted pants for exercise purposes.

* cited by examiner

*Primary Examiner* — Loan Thanh
*Assistant Examiner* — Victor K Hwang
(74) *Attorney, Agent, or Firm* — Jerry R. Potts

(57) ABSTRACT

A muscle toning kit includes an exercise garment having a first resistance article and a second resistance article. The first resistance article and the second resistance article cooperate to facilitate the exercise of at least one muscle group of a user. The first resistance article is adjustable to provide a range of user selected resistance levels, while second resistance article has another range of user selected resistance levels so that as the user maneuvers the exercise garment, its adjustable pressure opposing structures facilitate the toning and conditioning of the at least one muscle group of the user. The method includes wearing and deforming the exercise garment from its original shape through natural extension and flexing actions of the user to facilitate providing a resistive force to condition the at least one muscle group of the user.

25 Claims, 8 Drawing Sheets

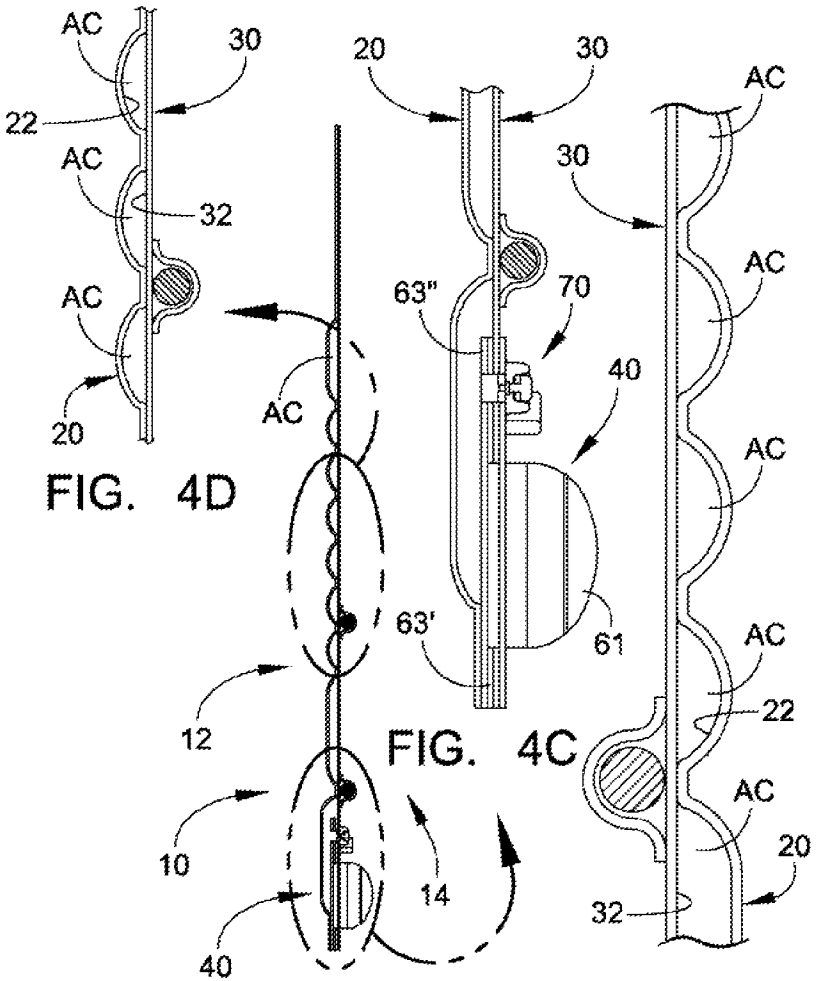
FIG. 4A
FIG. 4B
FIG. 4C
FIG. 4D
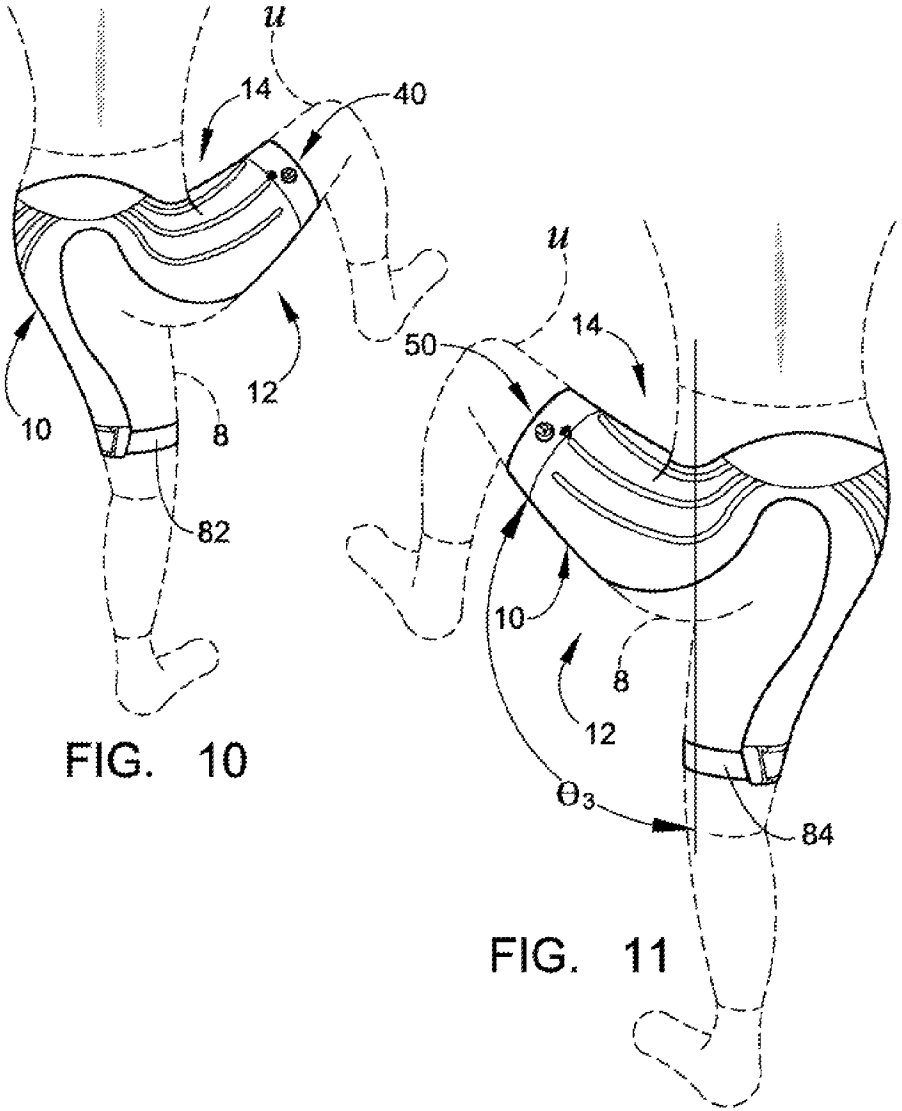
FIG. 10
FIG. 11

EXERCISE KIT, APPAREL ITEM AND METHOD OF USING SAME

CROSS-REFERENCE TO RELATED APPLICATIONS

Not Applicable

FIELD OF THE INVENTION

The present invention relates in general to exercise equipment as well as a method for providing muscle conditioning. The invention more particularly relates to a muscle toning kit and method which includes an apparel item that facilitates the conditioning or development of the muscles of a user by the repetitive or continuous activity the user.

BACKGROUND OF THE INVENTION

Exercise equipment for conditioning and toning muscles has existed in a variety of forms. The majority of such equipment for most part has been large, bulky and expensive except for garment type items. For example, reference may be made to U.S. Pat. Nos. 3,559,654; 3,759,510; 4,384,369; 5,033,123; 5,109,546; 5,465,428; 5,708,976; 5,842,859; 5,875,491; 5,897,423; 5,921,945; 5,978,965; 6,258,014; and 6,656,097.

U.S. Pat. No. 3,759,510 describes an exercise garment including a helmet, jacket, armlets, gloves, belt, shorts, thigh leggings, calf leggings and boots with these components being detachably connected together for the use of a total composite garment or for the use separately in various combinations, each component of the total garment having exterior pockets which may be filled or partially filled with a particular weight material of various densities. This exercise garment is cumbersome and should be worn on the outside, not underneath the clothes.

U.S. Pat. No. 5,033,123 relates to a garment that comprises a pair of trousers and optionally a solid upper jacket to form a combination suit. This garment is worn in such activities as lumbering and sporting where considerable body bending is involved. These trousers and jacket are worn on the outside, not as an undergarment.

U.S. Pat. No. 5,109,546 relates to an exercise suit with form fitting pants and pullover top made of stretchable material having reinforcing segments with helically wound leg and arm resistance bands attached integrally to the suit.

U.S. Pat. No. 6,520,893 relates to an inflatable exercise belt for placement around the abdomen of a user includes a substantially belt-shaped body. A selectively inflatable air chamber is disposed at a first end portion of the belt. A backing is disposed adjacent to the inflatable air chamber so that when the inflatable air chamber is inflated, it expands in a direction away from the backing thereby exerting pressure on the abdomen of the user.

U.S. Pat. No. 6,656,097 relates to an exercise kit having a lightweight foundation article of clothing having at least a pair of elongated pockets. An elongated bent elastomeric urethane member is secured within desired ones of the pockets and provides resistance when deformed and no resistance when restored resiliently to its original shape. The method of using the kit includes performing physical activities that includes movement of at least some portion of the body sufficient to cause the urethane member to deform and to provide sufficient resistance to the movement to tone the muscles of the user experiencing such resistance.

While such garments may have been satisfactory for certain situations, it would be highly desirable to have a new and improved exercise garment and kit, which is comfortable to wear and which provides good muscle toning without causing unwanted and undesired muscle strain or soreness.

SUMMARY OF THE INVENTION

A muscle toning kit includes an exercise garment having a first resistance article and a second resistance article. The first resistance article and the second resistance article cooperate to facilitate the exercise of at least one muscle group of a user. The first resistance article is adjustable to provide a range of user selected resistance levels, while second resistance article has another range of user selected resistance levels so that as the user maneuvers the exercise garment, its adjustable pressure opposing structures facilitate the toning and conditioning of the at least one muscle group of the user. The method includes wearing and deforming the exercise garment from its original shape through natural extension and flexing actions of the user to facilitate providing a resistive force to condition the at least one muscle group of the user.

BRIEF DESCRIPTION OF THE DRAWINGS

The above mentioned features of the invention and the manner of attaining them will become apparent, and the invention itself will be best understood by reference to the following description of the embodiments of the invention in conjunction with the drawings wherein:

FIG. 4A is a cross sectional view of the exercise device taken substantially along line 4A-4A of FIG. 4;

FIG. 4B is a cross sectional view of the exercise device taken substantially along line 4B-4B of FIG. 4;

FIG. 4C is an enlarged view of a portion of the cross sectional view of the exercise device of FIG. 4B;

FIG. 4D is an enlarged view of another portion of the cross sectional view of the exercise device of FIG. 4B;

FIG. 10 is a pictorial view of the exercise device of FIG. 4 secured to a user;

FIG. 11 is another pictorial view of the exercise device of FIG. 4 secured to a user;

BEST MODE FOR CARRYING OUT THE INVENTION

Figures 1, 2:
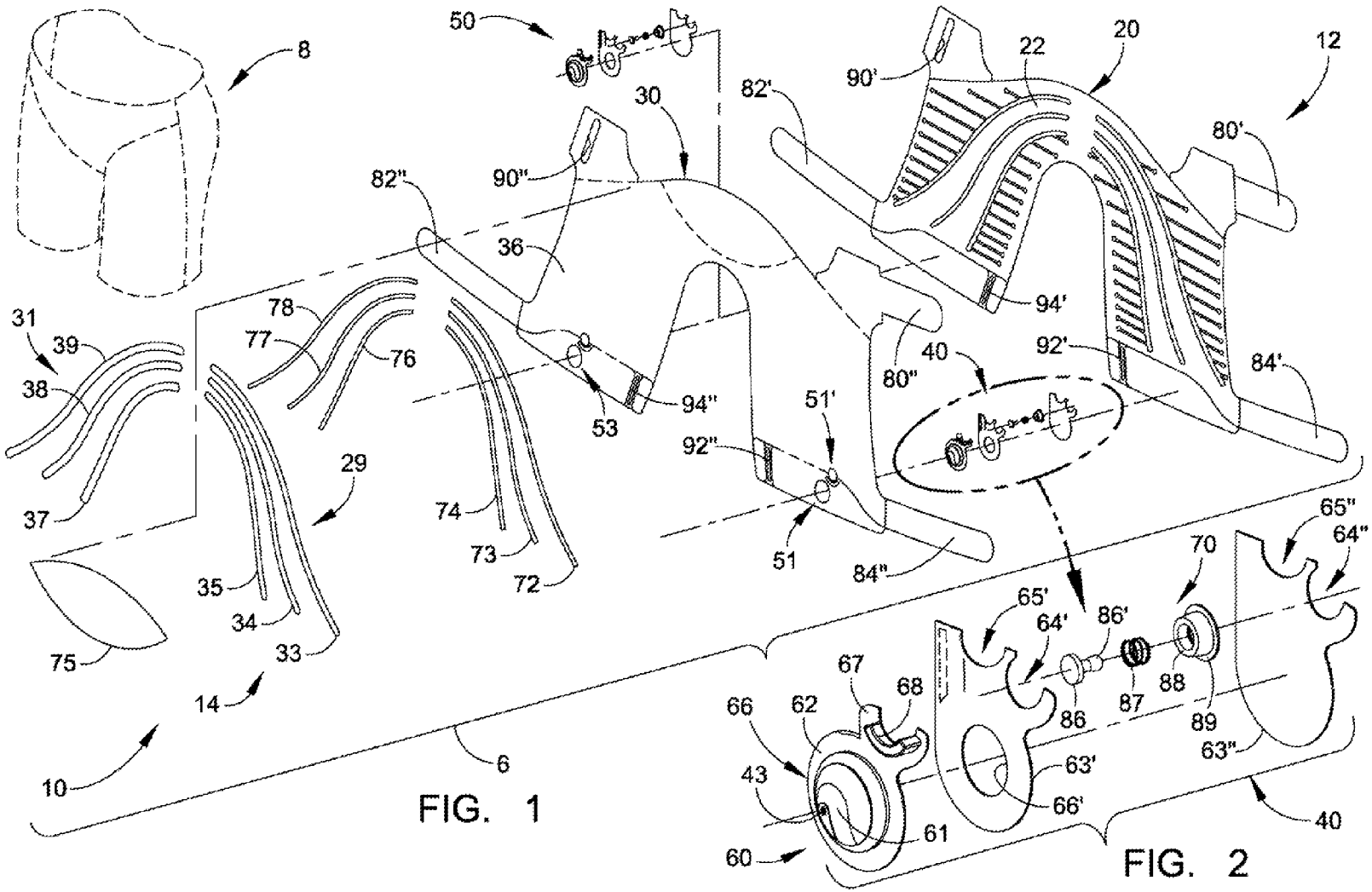
FIG. 1 is an exploded view of an exercise kit and device, which are constructed in accordance with the present invention.
FIG. 2 is an enlarged exploded view of an air pressure adjustment mechanism forming part of a first resistance article of the exercise kit of FIG. 1.
Figures 3, 3A, 3B:
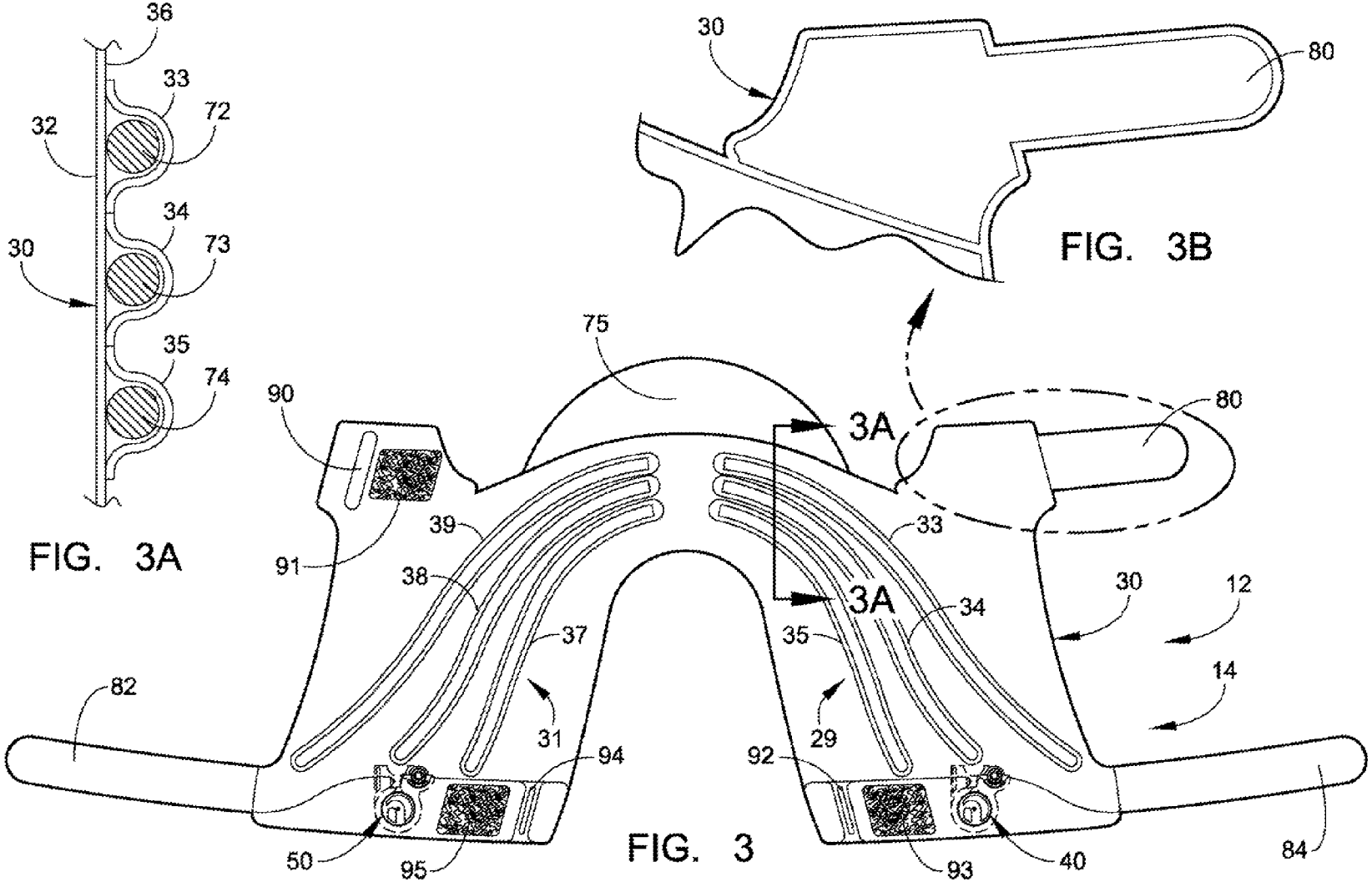
FIG. 3 is a rear plan view of a second resistance article forming part of the exercise kit and device of FIG. 1.
FIG. 3A is a cross-sectional view of the exercise device second resistance article taken substantially along line 3A-3A of FIG. 3.
FIG. 3B is an enlarged view of a first resistance article securing strap forming part of the exercise kit and device of FIG. 1.

Referring now to the drawings and more particularly to FIG. 1 there is illustrated an exercise kit 6 which includes a conventional exercise garment, such as a pair of exercise shorts 8, and an adjustable exercise device 10 which is adapted to be worn as a wearing apparel item by a user U (FIG. 6), over the conventional pair of shorts 8. The pair of shorts or cover pants can be spandex screen printed to provide the shorts 8 with a decorative appearance. The adjustable exercise device 10 is completely portable, light weight and when attached to the body of the user U, it is transformed from a substantially flat 2-dimensional wearing apparel article as best seen in FIGS. 4C and 6, into a 3-dimension wearing apparel article, as best seen in FIGS. 7-11. In this regard the exercise kit 6 can be easily worn by the user U during professional workout activities associated with football, soccer, baseball, basketball, and tennis for example, during gym or home exercise activities, or even during the activities experienced during the normal work day that includes walking, reaching, climbing, turning and running. In short then, the exercise kit 6 and exercise device 10 provide the user with a piece of portable exercise equipment which can be used to tone and exercise body muscles without causing unwanted and undesired muscle strain or soreness.

As will be explained hereinafter in greater detail, the exercise device 10 includes a plurality of dynamically adjustable pressure opposing structures which are arranged so the user can maneuver and adjust the pressure opposing structures either before securing the exercise device 10 to the body of the user or "on the fly" while the user is engaged in an exercise activity. The exercise device 10 therefore provides a plurality of different user selected resistance levels, which facilitate conditioning or developing of one or more one muscle groups of the user U.

The method of using the kit 6 to facilitate the conditioning or developing of one or more muscle groups of the user U, as best seen in FIGS. 6-11, include wrapping and overlaying the adjustable exercise device 10 around a selected body part of the user, such as around the waist, hips, buttocks and upper legs of the user; securing the adjustable exercise device 10 to the selected body part of the user U; adjusting the resistance levels of the exercise device 10 so the user can maneuver the pressure opposing structures of the exercise device 10 to provide a plurality of different user selected resistance levels which facilitate conditioning or developing of one or more one muscle groups of the user U; and engaging in any type of physical activity that will move the muscle group or groups covered by the exercise device 10 such as a professional workout activity, a gym or home exercise activity, or even normal work day activities that includes walking, reaching, climbing, turning and running.

Considering the adjustable exercise device 10 in greater detail with reference to FIGS. 1, 4B and 6, the exercise device 10 generally includes a first resistance article 12 which is adapted to be worn by the user U, to provide a plurality of adjustable pressure opposing structures at a first angle of resistance $\theta_1$ against one or more muscle groups of the user U, and a second resistance article 14 which is adapted to provide another plurality of pressure opposing structures at a second angle of resistance $\theta_2$ against the same one or more muscle groups of the user. In short then, as best seen in FIG. 7, the first resistance article 12 and the second resistance article 14 cooperate to provide at least two different angles of resistance for the opposing structures to operate against one or more muscle groups of a user. As will be explained hereinafter in greater detail, the level of resistance provided by first resistance article 12 is adjustable between a minimum resistance level and a maximum resistance level. Likewise, the level of resistance provided by the second resistance article 14 is also adjustable between a minimum resistance level and a maximum resistance level. In short then, the exercise device 10 not only provides two different angles of resistance for the opposing structures provided by the first resistance article 12 and the second resistance article 14, but also the resistance levels of those article 12 and 14 can be adjusted individually to provide a user with a wide range of resistance levels to effectively condition and develop one or more of the muscle groups of the user U. Moreover, due to the unique structure of the exercise device transforming from basically a 2-dimensional structure in a first configuration to a 3-dimensional structure in a second configuration, the user is provided with 360 degrees of opposing structures for operating against one or more muscle groups of a user.

Figures 4, 5:
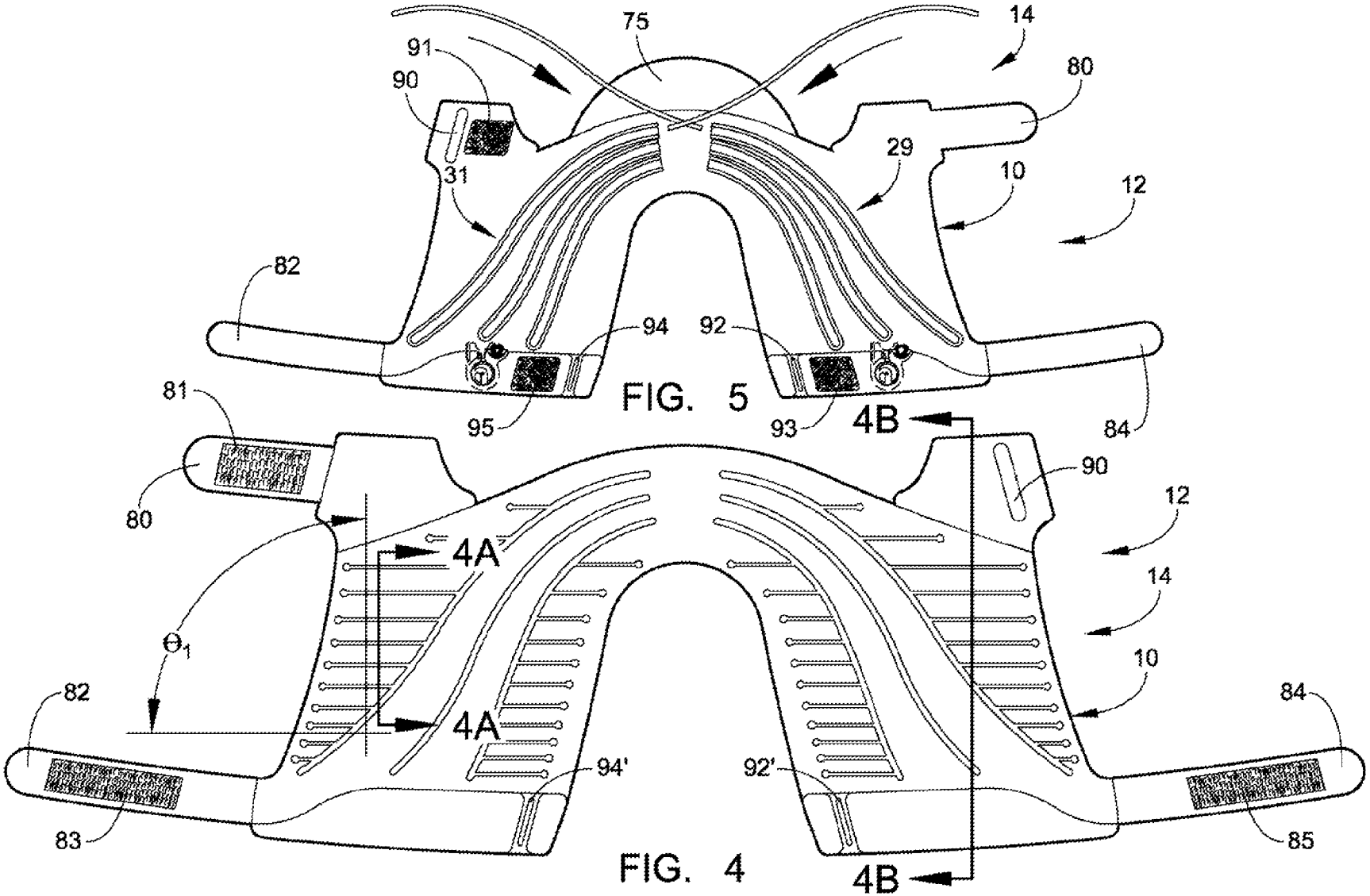
FIG. 4 is a rear plan view of the exercise device of FIG. 1.
FIG. 5 is a front plan view of the exercise device, illustrating it being loaded with resistance elements to adjust the resistance level of a second resistance article forming part of the exercise device of FIG. 4.
Figure 6:
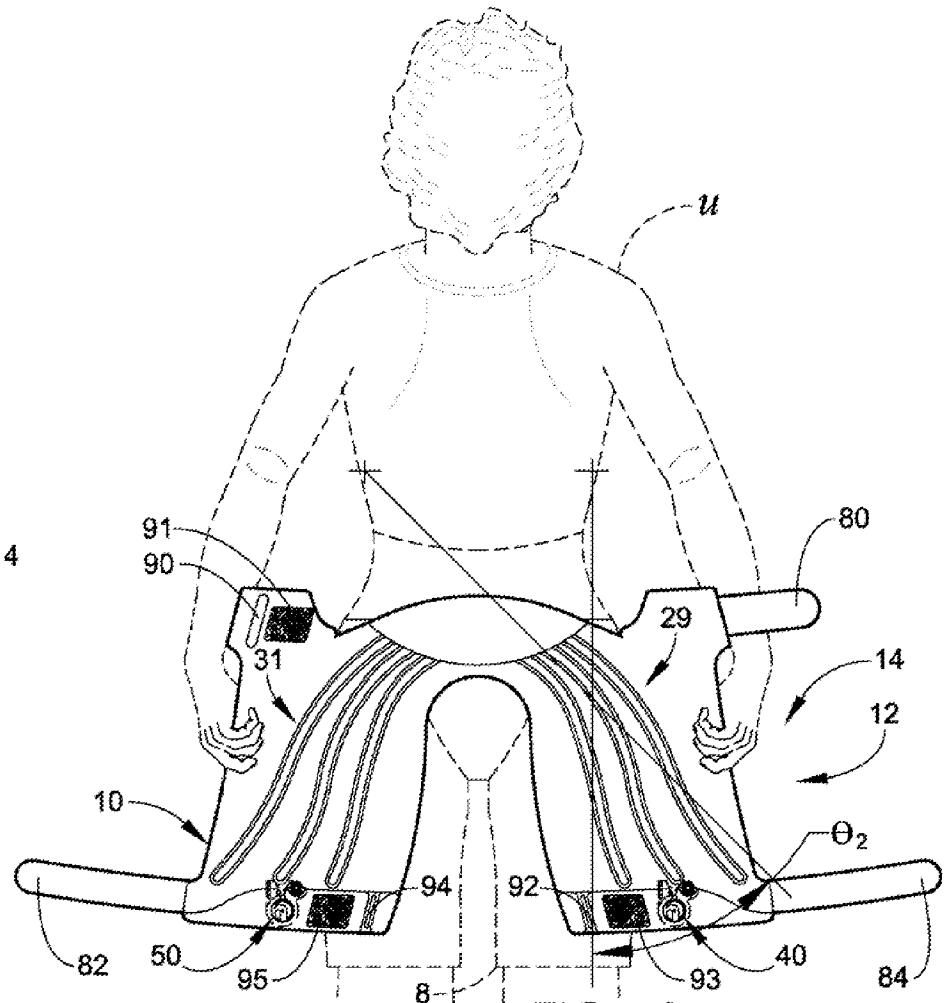
FIG. 6 is a rear pictorial view of the first resistance article of the exercise device, illustrating it in a flat mounting state about to be wrapped around and secured to a user.
Figure 7:
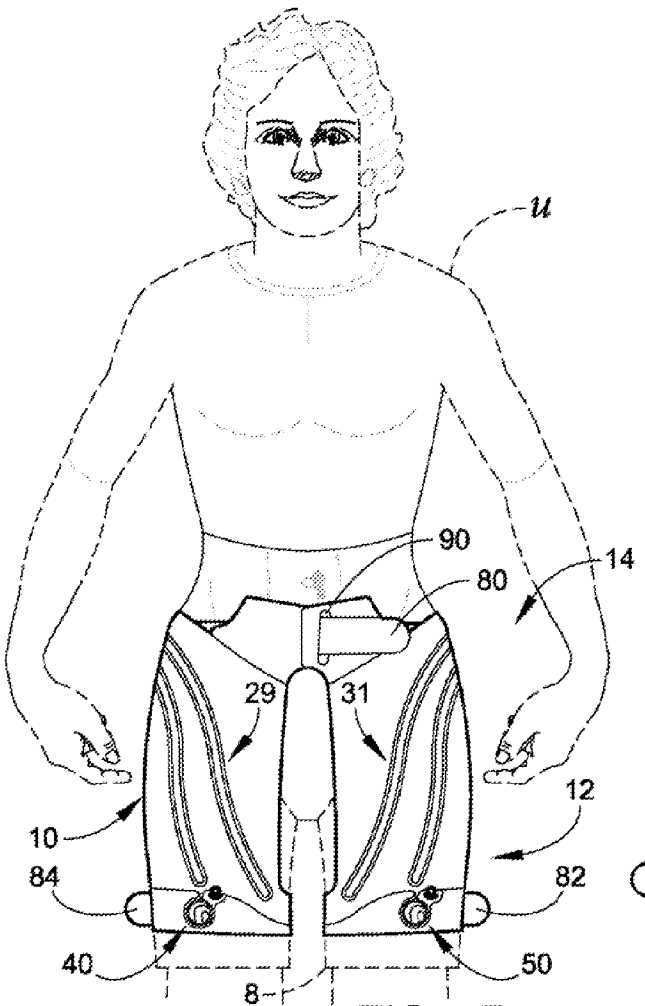
FIG. 7 is a front pictorial view of the first resistance article of the exercise device of FIG. 6, illustrating it wrapped around and secured to a user.

Considering now the angles of resistance provided by the first resistance article 12 and the second resistance article 14, in one preferred embodiment of the present invention, as best seen in FIGS. 4 and 6, the first angle of resistance $\theta_1$ is at about 90 degrees to the longitudinal axis L of the user, while the second angle of resistance $\theta_2$ is at about 45 degrees to the longitudinal axis L of the user. It should be understood by those skilled in the art, that the first angle of resistance $\theta_1$ and the second angle of resistance $\theta_2$ are chosen to provide the most effective and beneficial resistance levels for the muscle group or muscle groups that will be opposed by the resulting pressure structures. Moreover, when the exercise garment 10 is wrapped about the user, as best seen in FIGS. 6-11, the angles of resistance provided by the exercise garment 10 are transformed from a substantially flat 2-dimensional orientation plane as best seen in FIG. 7 and into a three-dimensional orientation as best seen in FIGS. 6, and 8-11 to provide the user with a 3-dimension workout article, which provides as mentioned earlier 360 degrees of opposing structures for operating against one or more muscle groups of a user. This is a unique and novel transforming structure which not only provides a wide variation in the angles of the opposing structures but which also provides the user with the ability to adjust the resistance levels of the opposing structure so that the selected resistance levels will enhance and specifically target the conditioning or developing of one or more muscle groups of the user U. In short, as the user manipulates the exercise device 10, it will provide various angles of resistance against a muscle group of the user, such as an angle of resistance $\theta_3$.

Although in the preferred embodiment of the present invention the disclosed first angle of resistance $\theta_1$ and the disclosed second angle of resistance $\theta_2$ have been described as being between about 90 degrees and about 45 degrees respectively, it should be understood by those skilled in the art, that other angles of resistance could be selected based upon the muscle group or groups that are targeted for development. Therefore there is no intention of limiting the scope of the disclosed first angle of resistance $\theta_1$ at about 90 degrees as the first angle of resistance $\theta_1$ can be selected to be between about 0 degrees and about 90 degrees, but most preferably to be about 90 degrees. Similarly, there is no intention of limiting the scope of the disclosed second angle of resistance $\theta_2$ at about 45 degrees as the second angle of resistance $\theta_2$ can be selected to be between about 0 degrees and about 90 degrees relative to the first angle of resistance $\theta_1$, but most preferably to be about 45 degrees relative to the first angle of resistance $\theta_1$.

Considering now the first resistance article 12 in still greater detail with reference to FIGS. 6-11, the first resistance article 12 is as mentioned earlier, a substantially flat, lightweight wearing apparel article as best seen in FIG. 6, which can be worn over the exercise garment 8. In this regard, the first resistance article 12 is completely portable when it is not being worn by the user. However, when attached or secured to the body of a user U, the first resistance article 12 is transformed from a substantially flat 2-dimensional wearing apparel article as best seen in 4B and into a 3-dimension article as best seen in FIGS. 10-11, which can be easily worn during professional workout activities associated with football, soccer, baseball, basketball, and tennis for example, during gym or home exercise activities, or even during normal work day activities that includes walking, reaching, climbing, turning and running in order to provide the user with a device that tones and exercise body muscles without causing unwanted and undesired muscle strain or soreness. The first resistance article 12 is a user adjustable tensioning structure which is constructed to provide a range of user selected resistance levels or at various angles of resistance, such as an angle of resistance $\theta_3$ wherein the user can maneuvers the pressure opposing structures of the first resistance article 12 by exerting an operating pressure or compression tension thereupon to facilitate conditioning or developing of one or more one muscle groups of the user. In short, the first resistance article 12 is adjustable tensioning means for overlaying at least one muscle group of the user to facilitate the applying of a user adjustable compression tension against at least one muscle group of the user.

As will be explained hereinafter in greater detail, a user can increase the opposing structure forces of the exercise kit 6 by overlaying a substantial portion of the first resistance article 12 with the second resistance article 14. The second resistance article 14 as will be explained hereinafter in greater detail, includes a plurality of memory resistant components which provide another range of user selected resistance levels, wherein the user may further maneuver the pressure opposing structures of the second resistance article 12 by simply exerting an operating pressure thereupon, which in turn facilitates conditioning or developing of the one or more muscle groups of the user.

To accommodate the above-mentioned wide variety of different kinds of physical activities, whether they be associated with a professional workout, a home or gym workout, or simply engaging in normal work day activities, the first resistance article 12 generally includes a flexible inside member 20 and a flexible outside member 30, which are shaped as best seen in FIG. 1. The inside member 20 and the outside member 30, when heat sealed together form an inflatable bladder as will be described hereinafter in greater detail. The inside member 20 and the outside member 30 are made of a flexible polyvinylchloride material, also known as a PVC material, which would be the most cost effective. In the alternative, the inside member 20 and the outside member 30 can be made from a thermo plastic urethane material or a polyurethane material, which would be more expensive. Other materials between these extremes would also be suitable, selected from the group consisting of, but not limited to polypropylene, polyethylene (PP); thermoplastic polyurethanes (TPU) sold under such names as Lycra® (by Dupont), Elaspan® (by Invista), Creora® (by Hyosuno), ROICA (by Asahi Kasei), Dorlastan® (by Asahi Kasei). Linel® (by Fillattice), ESPA® (by Toyobo), Elastollan® (by BASF), Pearlthane® (by Merouinsa), Desmopan® (by Bayer), Estane® (by Lubrizol), Pellethane® (by Lubrizol), Iroaran® (by Huntsman), Exelast EC® (by Shin-Etsu Polymer Eurpope B.V.), Laripur® (by COIM SpA), Avalon® (by Hutsman) Isothane® (by Greco); a fabric material coated in rubber or other thermoplastic materials such as silicone, and thermoplastic elastomeric or elastomer (TPE), sometimes referred to as thermoplastic rubber. Therefore, there is no intention of limiting the scope of the disclosed first resistance article 12 to a specific material type as a broad range of materials are contemplated within the true scope of the present invention.

Figure 9:
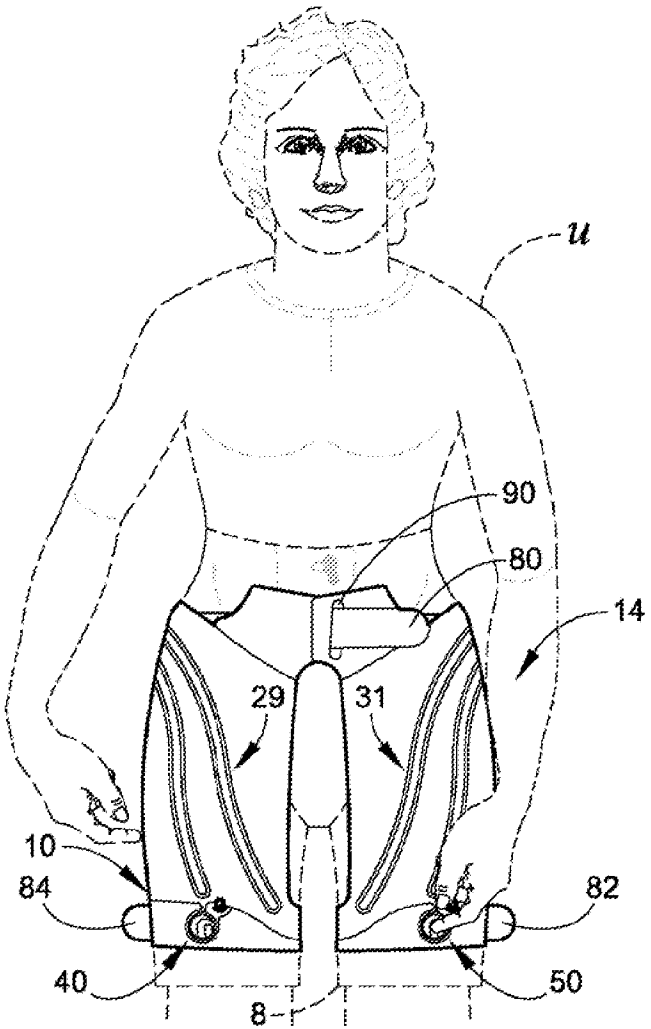
FIG. 9 is a front pictorial view of the first resistance article of the exercise device of FIG. 7, showing the user in the process of adjusting the resistance level of the first resistance article.
Figure 8:
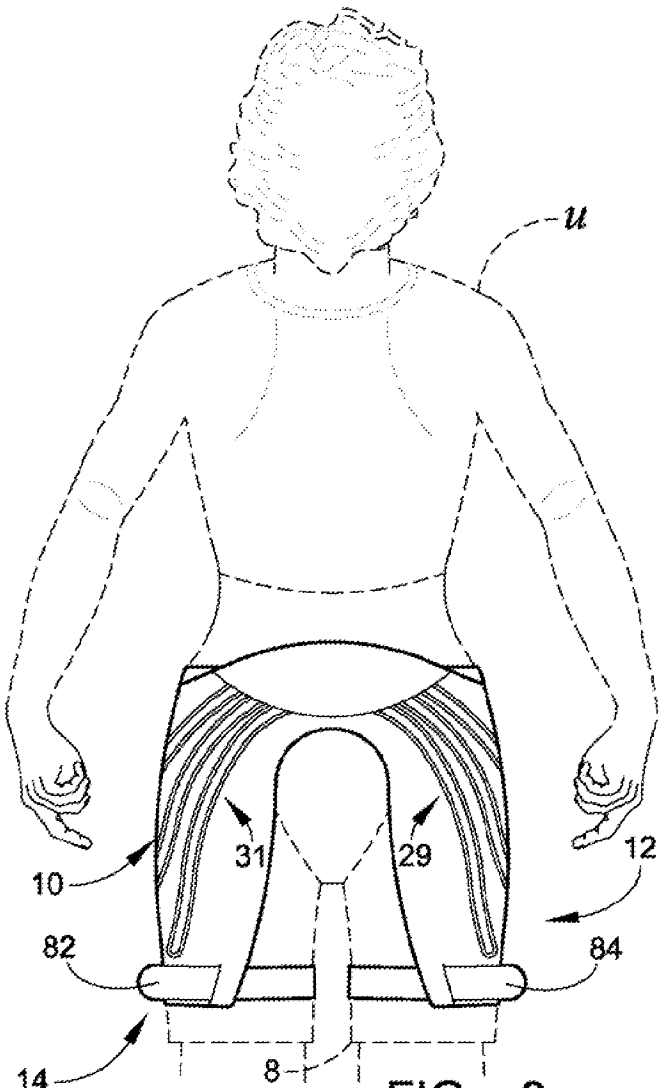
FIG. 8 is a rear pictorial view of the exercise device of FIG. 6, illustrating it wrapped around and secured to a user.

In order to control the resistance levels of the exercise device 10, as best seen in FIGS. 7 and 9, the first resistance article 12 includes a pair of air pressure adjustment mechanisms indicated generally at 40 and 50 respectively. The air pressure adjustment mechanisms 40 and 50 are utilized by the user U to control the resistance level of the first resistance article 12 by: 1) inflating the first resistance article 12 to a user selected resistance level; 2) deflating the first resistance article 12 to another user selected resistance level if needed or desired; or 3) to a completely deflate the first resistance article 12 for storage and transportation purposes. It should be noted that in the completely deflated state or level, the first resistance article 12 is a substantially flat 2-dimensional article as best seen in FIG. 4B, which flat 2-dimensional structure facilitates ease in storage and transportation of the exercise device 10. The pair of air pressure adjustment mechanisms 40 and 50 is provided so the resistance levels of the first resistance article 12 can be controlled relative to a right side portion of the first resistance article 12 and a left side portion of the first resistance article 12. This feature will be described hereinafter in greater detail.

It should be understood by those skilled in the art, that although the first resistance article 12 has been described as having a short pant like configuration, a the first resistance article may be configured in any desired shape not only to wrap around the waist, hips and upper legs of user, but it may also be configured to be wrapped around any extremity of a user, such as an arm, a leg, or other selected muscle areas such as the hips, buttocks, or even the abdomen of the user U. Therefore, there is no intention of limiting the scope of the disclosed first resistance article 12 to a pant like structure, as other types of exercise structures are contemplated within the true scope of the present invention, whether the structure of the exercise device be for an arm, a leg, an elbow area, a knee area, a back area, and abdomen area a neck area, a buttock area, or some combination of muscle areas such as the muscle area covered by the exercise device 10.

In summary then, the first resistance article 12 is a bladder like inflatable apparel article made of a number of component parts, which include: the inside or inner member 20, which is shaped as best seen in FIG. 1; the outside or outer member 30, which is shaped as best seen in FIG. 1; and the pair of air pressure adjustment mechanisms 40 and 50 respectively, as best seen in FIGS. 1 and 2. Each of these component parts will be described hereinafter in greater detail and are illustrated in the accompanying drawings. Similar or identical structures will not be individually described, instead only one of the similar or identical parts will be described in greater detail.

Considering now the first resistance article 12 in still greater detail, the inside member 20 and the outside member 30 are each substantially flat structures where the inside member 20 includes an interior bonding surface area indicated generally at 22 (FIGS. 4C and 4D) and where the outside member 30 includes an interior bonding surface area 32 (FIGS. 4C and 4D). The interior surface area 22 of the inside member 20 and the interior surface area 32 of the outside member 30 are substantially co-extensive with one another to form a desire garment shape with a specific size which is selected to wrap around a specific body part of the user. This co-extensive configuration also allows the inside member 20 and the outside member 30 to be heat sealed together at their bonding surface areas 22 and 32 respectively to form a flat uniform structure as best seen in the non inflated side-elevational view in FIG. 4B of the accompanying drawings.

When the inside member 20 and the outside member 30 are heat sealed together to form the first resistance article 12, they create a number of important features which facilitate the ease in attaching the first resistance article 12 to the body of the user. These features include: an elongate waist strap feature indicated generally at 80, an elongate right leg strap feature indicated generally at 82 and an elongate left leg strap feature indicated generally at 84. Also formed are strap receiving slots for receiving these straps 80, 82 and 84 respectively, which slots include a waist strap receiving slot indicated generally at 90, a right leg strap receiving slot 92 and a left leg strap receiving slot 94.

To facilitate securing or cinching each strap within its respective slot, the first resistance article 12 is also provided with a plurality of hook and pile pad groups which includes a waist hook pad 81 disposed on the waist strap 80, a waist pile pad 91 disposed adjacent to the waist strap receiving slot 90, a right leg hook pad 83 disposed on the right leg strap 82, a right leg pile pad 93 disposed adjacent to the right leg receiving slot 92, a left leg hook pad 85 disposed on the left leg strap 84, and a left leg pile pad 95 disposed adjacent to the left leg receiving slot 94, which pads 81, 83, 85, 91, 93, and 95 are adhesively secured to the appropriate surfaces of the first resistance article 12 as indicated to enable respective hook and pile groups to engage for securing the first resistance article 12 to the body of the user at the waist and legs respectively as best seen in FIGS. 6-11.

As the inside member 20 and the outside member 30 are co-extensive with one another, each of the members 20 and 30 contribute to the formation of the straps 80, 82, and 84, as well as to the strap receiving slots 90, 92, and 94. In this regard, the inside member 20 includes corresponding strap portions 80', 82' and 84' and corresponding slot portions 90', 92' and 94' as best seen in FIG. 1. In a similar manner, the outside member 30 includes corresponding strap portions 80", 82", and 84" and corresponding slot portions 90", 92", and 94" also, as best seen in FIG. 1.

Figure 12:
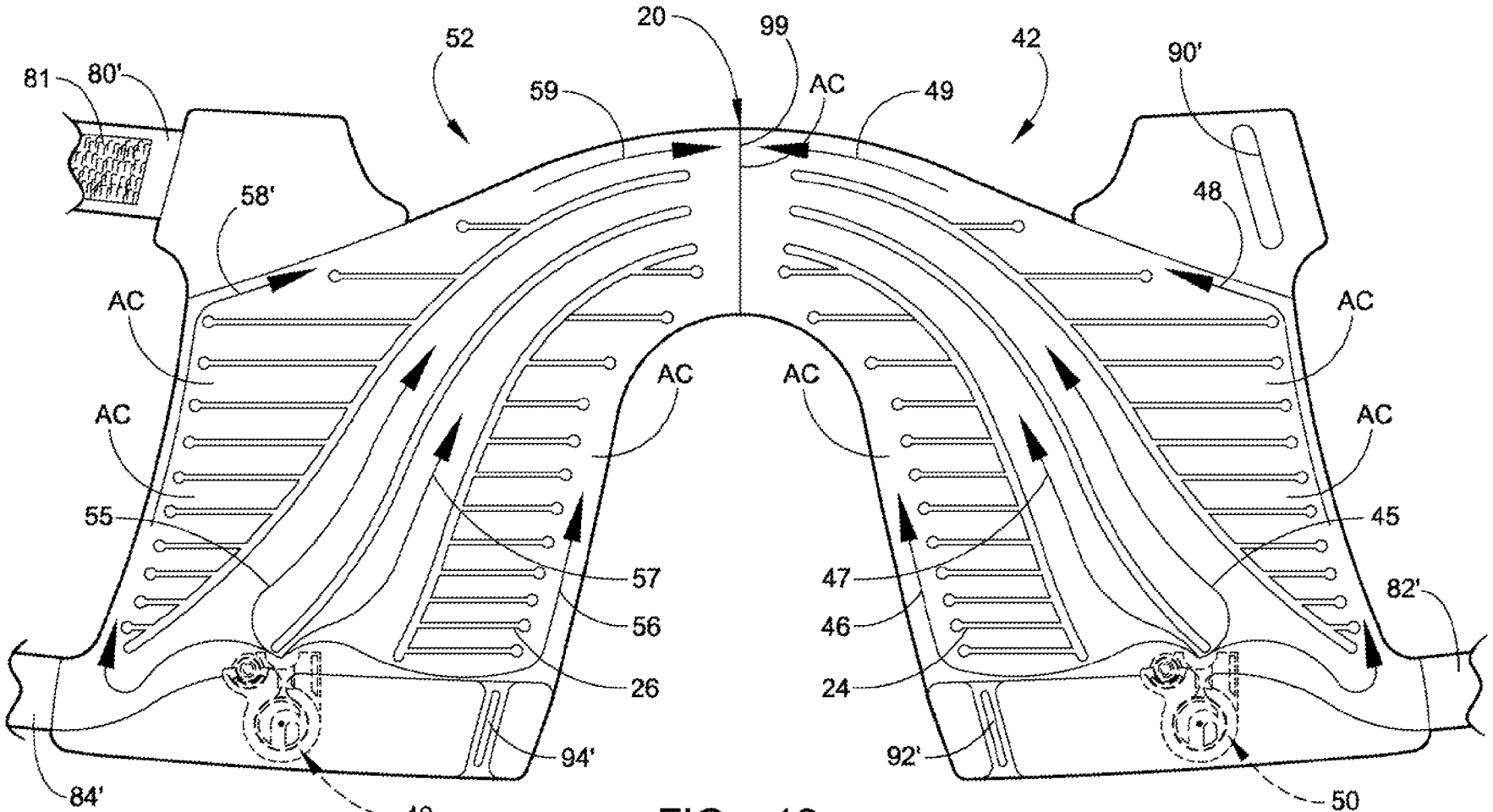
FIG. 12 depicts the fluid paths within the first resistance article of FIG. 6.

As will be explained hereinafter in greater detail, the inside member 20 has a plurality of die alignment marks, such as for example, a die alignment mark 24 and a die alignment mark 26 as best seen in FIG. 12. This plurality of die alignment marks are utilized to define the interior bonding area 22 of the inside member 20, which marks further facilitate the creation of a plurality of air chambers AC formed in a heat sealing process between the interior bonding surface area 22 of the inside member 20 and the interior bonding surface area 32 of the outside member 30. For now, it will suffice to state a heating die (not shown) presses against the inside member 20 and the outside member 30 at the die alignment marks heating them to cause the plurality of air chambers, such as air chambers AC to be formed as best seen in FIGS. 4, and 4A-D.

The die alignment marks on the inside member 20 are arranged so that when the interior surface of the front member is heat sealed to the interior surface of the outside member 30 the first resistance article 12 is formed and configured into a plurality of inflatable, inter connected air chambers AC. When the front member 20 and the back member 30 are heat sealed together, they also form two separate inflatable sections, an inflatable right side group of air chambers, indicated generally at 42 (FIG. 12) for facilitating directing a pressure force against a right side group of muscles and an inflatable left side group of air chambers, indicated generally at 52 (FIG. 12) for facilitating directing a pressure force against a left side group of muscles. In the preferred embodiment of the present invention, the inflatable right side group 42 of air chambers and the inflatable left side group 52 of air chamber can be inflated independently of one another. However, it is contemplated that the two groups 42 and 52 respectively of air chambers AC could be arranged to be inflated simultaneously if desired. Therefore there is no intention of limiting the scope of the disclosed inflatable chambers to a specific number of groups, as one or more groups are contemplated within the true scope of the present invention.

As best seen in FIG. 12, the front member 20 includes a plurality of air passageways indicated at 45-49 interconnect the air chambers AC in the right side group 42 of air chambers AC and a plurality of air passageways 55-59 interconnect the air chambers AC in the left side group 52 of air chambers. A barrier 99 separates the right side group 42 of air chambers AC from the left side group 52 of air chambers AC. It should be noted however, that the bladder like structure of the first resistance article 12 permits air to flow from the front of the article 12 (when seen as being worn by the user in FIGS. 7 and 9, for example) to the rear of the article 12. For drawing clarity purposes only a portion of the air chambers AC disposed in the right side group 42 of air chambers AC in FIG. 12 are designated with a reference character AC. Similar for drawing clarity purposes only a portion of the air chambers AC disposed in the left side group 52 of air chambers AC in FIG. 12 are designated with a reference character AC. The arrangement and number of air chambers AC in the groups 42, 52 can be easily seen in FIG. 12 without such reference character designations for all the air chambers.

As best seen in FIG. 1, the outside member 30 is provided with a pair of apertures or inlets indicated generally at 51 and 53 respectively. When the inside member 20 and the outside member 30 are heat sealed together these apertures 51 and 53 form a pair of irregular shaped openings or apertures to the interior air chambers AC of the first resistance article 12. These opening 51 and 53 provide an air passageways from the outside atmospheric air into the interior bladder air chambers AC formed between the inside member 20 and the outside member 30. The inlets 51 and 53 are arranged to provide access to the right side group 42 of air chambers AC and the left side group 52 of air chambers AC respectively.

As will be explained hereinafter in greater detail, the inlet 51 on the bottom right side of the first resistance article 12 is configured for receiving therein a portion of the air pressure adjustment mechanism 40 so that the right side group 42 of air chambers AC may be filled with air or alternately be deflated if already filled with air. The inlet 53 provided on the bottom left side of the first resistance article 12, provides another air passageway which is in fluid communication with the air chambers AC in the left side group 52. The inlet 53 is configured for receiving therein a portion of the other air pressure adjustment mechanism 50 so that the left side group 42 of air chambers AC may be filled with air or alternately be deflated if already filled with air. In this regard, the air pressure in the right side group 42 of air chambers AC can be controlled independently of the air pressure in the left side group 52 of air chambers AC. Alternately, the air pressure in the left side group 52 of air chambers AC can be controlled independently of the air pressure in the right side group 42 of air chambers AC.

From the foregoing, it should be understood by those skilled in the art that the inside member 20 and outside member 30 may be configured to form any number of air chambers, such as the air chambers AC. In this regard, there could be a single air chamber on the right side and a single air chamber on the left side; alternatively, there could be a plurality of air chambers on the right side and a plurality of air chambers on the left side. Therefore there is no intention of limiting the number of air chambers that may be formed by heat sealing the inside member 20 to the outside member 30 since one or more air chambers are contemplated within the true scope and spirit of the present invention.

More specifically, it should be understood by those skilled in the art, that the number of air chambers formed during the construction of the foundation article 12 is determined to be that number of air chambers which are necessary for facilitating the exercising of any selected muscle group or groups of a user. For example, there could be a single air chamber or there could be a plurality of air chambers. Alternately, there could be a plurality of inflatable, interconnect air chambers on a right-side of the body to facilitate right-side muscle toning, and a plurality of inflatable, interconnect air chambers on a left-side of the body to facilitate left-side muscle toning. The right side and left side air chambers could also be interconnected through a turn valve (not shown) that would direct air from the left side of the first resistance article 12 to the right side of the first resistance article 12 or from the right side of the first resistance article 12 to the left side of the first resistance article 12. Therefore there is no intention of limiting the scope of the present invention to a specific number of air chambers or their interconnections as different configurations of air chambers and interconnections are contemplated within the scope of the present invention.

As already noted earlier, in order to facilitate the inflating of the right side group 42 of air chambers AC independently of the left side group 52 of air chambers AC; the right side group 42 of air chambers AC is in fluid communication with the air pressure adjustment mechanism 40. In a similar manner in order to facilitate the inflating of the left side group 52 of air chambers AC independently of the right side group 42 of air chambers, the left side group 52 of air chambers AC is in fluid communication with the air pressure adjustment mechanism 50. As the air pressure adjustment mechanisms 40 and 50 are substantially similar, only the air pressure adjustment mechanism 40 will be described hereinafter in greater detail.

Considering now the right side air pressure adjustment mechanism 40 in greater detail with reference to FIG. 2, the right side air pressure adjustment mechanism 40 generally includes an inflating mechanism indicated generally at 60 and a deflating mechanism indicated generally at 70. Each of these components will now be described in greater detail.

Considering now the inflating mechanism 60 in greater detail with reference to FIGS. 1 and 2, the inflating mechanism 60 generally includes a two piece one way inflate valve indicated generally at 63 (FIG. 14) and a bulb pump indicated generally at 66 (FIG. 2). The bulb pump 66 has a unitary construction and includes a flat body portion 62 with a centrally disposed hemispherical flexible bulb 61 extending upwardly therefrom and an irregular shaped right ear portion 67 which has extending upwardly therefrom an upstanding sectional stop 68. The bulb pump 66 is made of a molded rubber material such as butyl rubber or a latex rubber which easily forms the flexible bulb 61. The bulb pump 66 may also be molded urethane or any other material having good memory characteristics. As best seen in FIG. 2, the bulb 61 and the upstanding sectional stop 68 are configured and sized to pass through the inlets 51 and 51' so that the flat portion 62 butts against the inside surface 32 of the outside sheet 30. The bulb pump flat portion 62 is then heat sealed to the inside surface of the outside sheet to form an airtight seal.

Figures 13, 14:
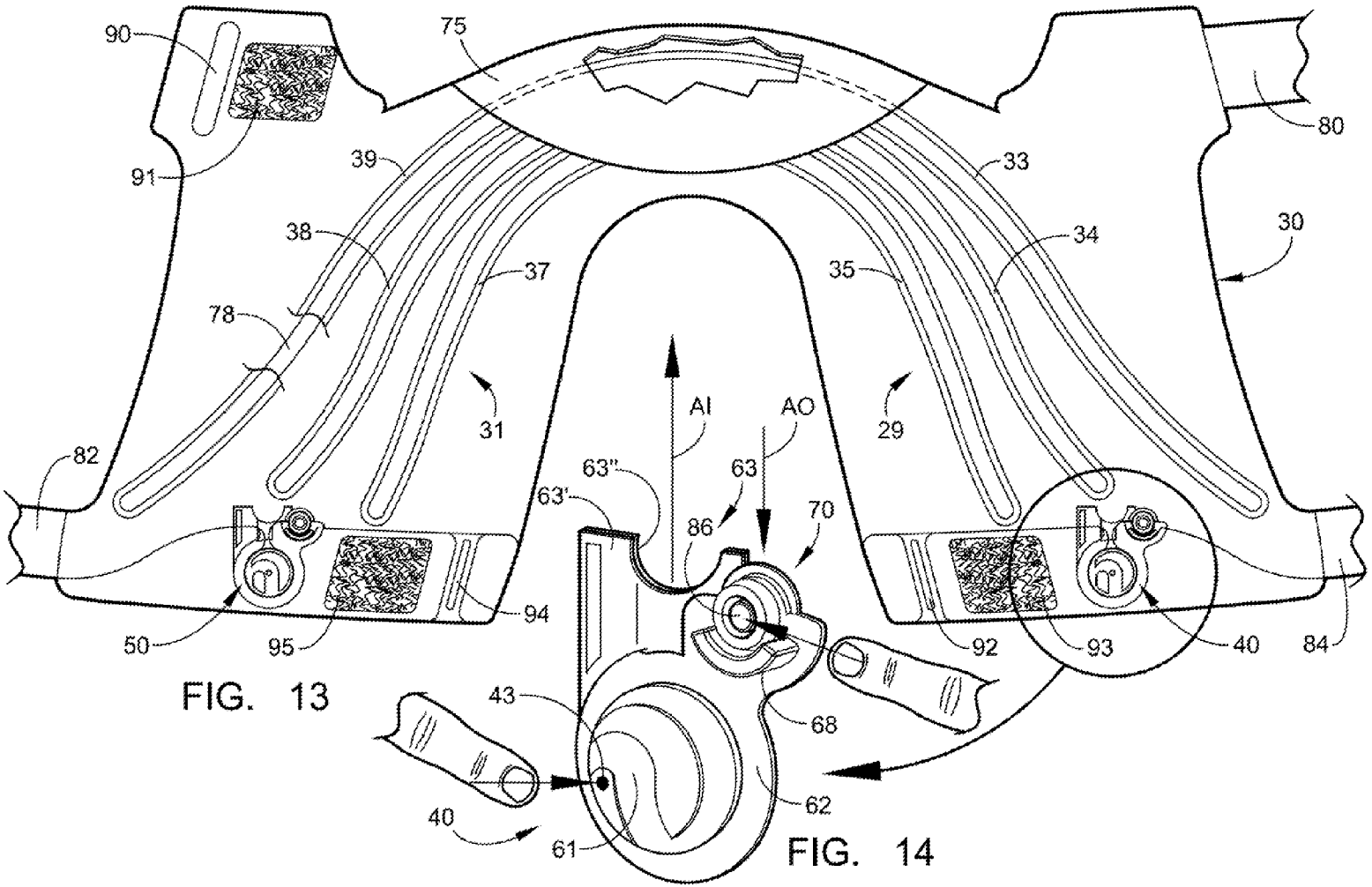
FIG. 13 is a front plan view of the exercise device of FIG. 1, illustrating the orientation of the second resistance article relative to the first resistance article.
FIG. 14 is an enlarged pictorial view of the air pressure adjustment mechanism of FIG. 2, illustrating a user in the process of engaging in one case an associated inflating mechanism and in another case an associated deflating mechanism.

A small hole or aperture 43 is formed in the top of the bulb 61 which hole 43 functions as first one way valve. That is, by using a small hole 43 in the top of the bulb 61, air is not permitted to escape to the atmosphere when the bulb 61 is depressed because the thumb or finger of the user covers the hole as best seen in FIG. 14. When the user releases his or her thumb or finger from the hole 43, atmospheric air is able to pass through the hole 43 and to fill the bulb 61.

The inflate valve 63 is a second one way valve, which is in fluid communication with the interior area of the bulb 61 and the air chambers AC in the right side section 42. The second one way valve or inflate valve 63 includes a pair of irregularly shaped sheet member 63' and 63" each having cutout areas indicated generally at 64' and 64" respectively, and cut out areas indicated generally at 65' and 65". Inflate valve member 63' differs from inflate member 63" in that inflate sheet member 63' has a centrally disposed hole 66' and inflate sheet member 63" does not have a centrally disposed hole.

The two irregularly shaped sheet members 63' and 63" are heat sealed together except at about the cut out areas 65' and 65". The outside face area of the inflate valve 63' is heat sealed to the back side of bulb pump 66, after the bulb pump 66 has been heat sealed to the outside sheet 30. In this regard, the bulb pump 66 is heat sealed to the outside sheet 30 by first passing the bulb 61 and the sectional stop 68 through their respective outside sheet inlet or mounting holes 51 and 51' respectively in the direction indicated in FIGS. 1 and 2. Once so mounted within the outside sheet 30, the back side of the flat body portion 62 of the bulb pump 66 is heat sealed to the interior surface of the outside sheet 32. Next, with the bulb pump 66 mounted to the outside sheet 30, the inflate valve member 63' is aligned with the back side of the bulb pump 66 so that the outside diameter of its centrally disposed hole 66' is aligned along a common axis A (FIG. 2) with the bulb 61 where it is heat sealed to the back side of the bulb pump 66. The front side of the inflate valve member 63" is then heat sealed to the back side of the inflate valve member 63' along all of its edges except at the cutout areas 65". This common cutout area indicated at 65' and 65" is then free to flap open when atmospheric air is pushed out of the bulb 61 into the inflate valve 63. When there is no air pressure to push open the inflate valve 63, the two sheets 63' and 63" close together so air can not escape from the air chambers AC in the right side 42. In this regard, when the bulb 61 is depressed, air captured within the bulb 61 will pass through the hole 66' and into the interior of the first resistance article 12 via the air passage way disposed in the inflate valve 63 at about the cutout areas 65' and 65" and into the right section 42 along the passageway indicated generally at AI. The inflate valve 63 (the pair of sheets 63' and 63" respectively) and the bulb pump 66 are both composed of a urethane material. Thus, a simple one way valve is constructed which is inexpensive and simple to manufacture.

In operation, the bulb 61 of the inflating mechanism 60 is depressed. The user typically will use a thumb to depress the bulb 61 therefore the hole 43 is covered and air is forced out of the bulb 61 into the second air valve 63 in the right section 42. As air is forced out of the body portion 60 under pressure of the thumb of the user, the sheets forming the one way valve 63 are forced open allowing the air to pass into the air chambers AC in the right section 42 along the air passageways indicated generally at 45-49. After the bulb 61 is released by the thumb of the user, the second one way valve 63 is closed so that air may now passes through the hole 43 to fill the interior space of the bulb 61. By repeating this process, the air chambers AC in the right section 42 may be filled to a desired air pressure by the user.

To release air from the air chambers (AC) in the right section, the first resistance article 12 is provided with the deflating mechanism or release valve 70. The release valve 70 is in fluid communication with the air chambers AC in the right section 42. A portion of the release valve 70 is mounted through a hole 51' in the outside member 30 which provides fluid communication with the right side group 42 of air chambers AC. As mounted the release valve 70 is located adjacent to the stop 68 where it can be conveniently activated by the user U. The release valve 70 as best seen in FIG. 2, includes a release valve button or plunger 86, a spring steel a spring 87 which is configured to bias the plunger 86 in a closed position as shown in FIG. 4C. A base member 88 having a flange 89 and centrally disposed plunger receiving hole is heat sealed between the outside member 30 and the inflate valve member 63'. The plunger 86 and more particularly its stem 86' is insert through the spring 87 and through the plunger receiving hole in the base member 88 so the spring 87 and stem 86' are movably captured within the base member 88 with the stem 86' disposed within the plunger receiving hole which blocks the escape of air from the right group 42 of air chambers AC to the atmospheric air. In this regard, the base member 88 forms a plunger receiving cup which is dimensioned to surround the periphery of the plunger stem 86', and when biased in the closed position the stem 86' of the plunger 86 keeps air from escaping between the plunger 86 and the base member 88. To release air from the right side 42 air chambers AC, the plunger 86 is depressed by the finger of the user U as best seen in FIG. 14 allowing the stem 86' to be move sufficiently so that air can then escape around the stem 86'of the plunger 86 from the plunger receiving hole, thus exiting air out indicated generally by line AO to the atmospheric air outside the exercise apparel 10. The release button 86 and the release valve base 88 are both manufactured of a PVC material. In this regard, this release valve 70 assembly is mechanically simple, is inexpensive to manufacturer, and is light weight.

While a particular type of release valve has been described in the preferred embodiment of the present invention, it should be understood by those skilled in the art, that there may be a number of different types of release valves which are suitable for practicing the invention. Therefore there is no intention of limiting the scope of the present invention to the disclosed release valve as other types of release valves are contemplated within the true scope of the present invention.

Considering now the second resistance article 14 in greater detail with reference to FIGS. 1, 3, and 6-11, the second resistance article 14 generally includes a plurality of elongate resistance element covers arranged in a right group 29 of covers 33-35 and a left group 31 of covers 37-39. The covers are heat sealed to the exterior surface 36 of the outer member 30 to form a set of pockets. The pockets are permanently closed at their distal ends and are open at their proximal ends. The pockets or covers are dimensioned for receiving therein one or more elongate resistance elements, such as the resistance elements 72-74 and the resistance elements 76-78. A closure flap 75, which is heat sealed and secured to the upper periphery area of the outside member 30 is configured to lift up to allow for the insertion of resistance elements and then to flip down to close over the proximal end openings of the covers 33-35 and 37-39. In this manner, any resistance elements, such as a resistance element 72, which may be inserted into its corresponding pocket cover, where it will be securely retained so it can not be dislodged while the user is using the exercise device 10.

To further facilitate the conditioning or development of a muscle group of the user, the exercise garment 10 is configured to be provided with a plurality of resistance elements, such as the resistance elements 72-74 and 76-78 (FIG. 1), which resistance elements are resilient memory members. The resistance elements in one preferred embodiment are elongated muscle wires where each muscle wire is composed of a shape memory alloy, such as steel alloys and titanium alloys. Each resistance element, such as the resistance element 72, is selected from a group of shape memory alloys that includes copper-zinc-aluminum-nickel, copper-aluminum-nickel, nickel-titanium, and copper-nickel titanium.

The utilization of a shape memory alloys in the resistance elements of the exercise garment 10 is an important feature of the present invention. In this regard, the shape memory alloy, which is also sometimes called a smart metal, a muscle wire, a smart alloy or a memory alloy, is a lightweight alloy that "remembers" its original, cold, forged shape, and which returns to that shape after being deformed by applying heat. In this case, the individual memory shape elements are configured and composed of muscle wire which deforms at or about the body temperature of the user, so it deforms to provide dynamic tensioning and compressing when the exercise garment 10 (memory shape element within the garment) is deformed from an original shape through the natural extension and flexing actions of a user wearing the exercise garment 10. In this regard, each of the resistance elements 72-74 and 76-78 are original flat substantially 2-dimensional articles which can be easily inserted into their respective pockets or covers, such as the covers 33-35 and 37-39 respectively, when the first resistance article 12 is in its 2-dimensional configuration as best seen in FIG. 6. Once the resistance elements 72-74 and 76-78 have been secured within their respective pockets utilizing the closure flap 75, the first resistance article 12 and the second resistance article 14 as best seen in FIG. 6, can be distorted as they are wrapped around the body of the user U and secured using the waist strap 80 and the leg straps 82 and 84 respectively as best seen in FIG. 7. When the exercise device 10 is so mounted to the body of the user U, it is transformed from its substantially flat 2-dimensional configuration as shown in FIG. 6, to the 3-dimensional configuration as shown in FIG. 6. The user U is then free to adjust the resistance level of the first resistance article 12 by increasing the air pressure within the various air chambers AC using the right side pressure adjustment mechanism 40 and the left side pressure adjustment mechanism 50. The user U is also able to adjust the opposing structures of the second resistance article 14 by inserting one or more of the resistance elements, such as the resistance elements 72-74 and 76-78, into their respective pockets or covers 33-35 and 37-39 respectively.

It should be understood by those skilled in the art, the user U, prior to mounting the exercise device 10 to his or her person, selects the resistance level of the second resistance article 12 but selecting one or more of the resistance elements, such as the resistance element 72, for use with the first resistance article 12. The resistance elements are inserted from the back of the first resistance article 12 and insert to a position in the front of the article 12 only when the article 12 is wrapped around the body of the user U. In this regard, the resistance elements are inserted only when the article 12 is not being worn by the user U. In this regard, the user U can adjust the resistance level of the second resistance article 12 before securing the exercise device 10 to his or her body. The resistance elements 72 and 78 have similar shapes and radii. In order to allow the user U to have a selection of resistance elements with different resistance levels, the resistance elements are configured differently from one another where resistance elements 73 and 77 have first shapes and first radii; where resistance elements 74 and 76 have shapes and second radii; and where resistance elements 72 and 78 have third shapes and third radii. Although the resistance elements have different shapes and radii, they all are configured to provide a second angle of resistance $\theta_2$ where the second angle of resistance $\theta_2$ can be selected to be between about 0 degrees and about 90 degrees relative to the first angle of resistance $\theta_1$, but most preferably to be about 45 degrees relative to the first angle of resistance $\theta_1$. In short, the resistance elements 72-74 and 76-79 are configured when worn by a user U, to wrap from the rear of the user U to the front of the user so resistance is experienced by the back leg muscles of the user, the buttock area muscles of the user, and the front leg muscles of the user in a simultaneous manner so that 360 degrees of resistive forces are provided.

Once the device 10 has been secured to the body of the user U, the user U, can "on the fly", while the user is engaged in an exercise active, easily and conveniently adjust the resistance level of the first resistance article 12 using one or both of the pressure adjustment mechanisms 40 and 50 respectively. From the foregoing, it should be understood that the plurality of dynamically adjustable pressure opposing structures of the exercise device 10 are arranged so the user can maneuver and adjust them either before securing the exercise device 10 to the body of the user or "on the fly" while the user is engaged in an exercise activity. Such adjustments can be made "on-the-fly" to both the first article of resistance 12 and the second article of resistance 14. The exercise device 10 therefore provides a plurality of different user selected resistance levels, which facilitate conditioning or developing of one or more one muscle groups of the user U.

Although in the preferred embodiment of the present invention, the plurality resistance elements 72-74 and 76-78 have been described as being composed of a memory alloy, it will be understood by those skilled in the art that they may also be composed of other acceptable materials such as steel springs, nylon, fiberglass rods, a combination of laminated materials as listed herein, spring steel coated in a PVC material, Kevlar, polyurethane rubbers, plastics with memory and carbon fiber materials where all such materials provide a sufficient dynamic tensioning and compressing action when the resistance element or the memory shape element is deformed from an original shape through the natural extension and flexing actions of the user wearing the exercise garment 10.

Also, although in the preferred embodiment of the present invention the plurality of resistance elements 72-74 and 76-78 of the second resistance article 14 have been described as having an irregular 2-dimensional shape when seen in a plane view, and an irregular 3-dimensional shape when mounted on the user U (using the first resistance article 12 as a mounting structure), it should be understood by those skilled in the art that each resistance element used in the second resistance article 14 may be configured as a unitary structure having a general U-shape so that one resistance element may be disposed between two covers or two pockets simultaneously, such as a single resistance element disposed between the pockets or covers 33 and 39 respectively.

Considering now the method of using the exercise kit 6 in greater detail, the method of using the exercise kit 6 includes the following steps:

1. selecting a substantially flat wrap-around exercise device or garment 10 with a specific shape and function to help facilitate the exercise of at least one muscle group of the user U;

2. providing the user U with the selected exercise device or garment 10 which exercise device or garment 10 is adapted to be worn over an article of clothing worn by the user, like a pair of exercise shorts 8;

3. determining that the selected exercise device or garment 10 includes a first resistance article 12 and a second resistance article 14, where the first resistance article 12 facilitates the exercise of at least one muscle group of the user and includes a plurality of pressure opposing structures or air chambers AC to provide a range of user selected resistance levels wherein the user U can further maneuver the pressure opposing structure (AC) of the first resistance article 12 by exerting an operating pressure thereupon to facilitate conditioning or developing of the at least one muscle group of the user U; and where the second resistance article 14 is configured to cooperate with and overlay the first resistance article 12 to further facilitate the exercise of the at least one muscle group of the user; and where the second resistance article 12 includes at least one resistance element selected from another plurality of pressure opposing structures or resistance elements 72-74 and 76-78 to provide another range of user selected resistance levels, wherein the user can further maneuver the pressure opposing structure of the second resistance article 14 by exerting an operating pressure thereupon to facilitate conditioning or developing of the at least one muscle group of the user;

4. mounting the exercise device or garment 10 on the user U, transforming its shape from a substantially flat 2-dimensional wrap-around garment 10 into a substantially 3-dimensional wrap-around garment 10 conforming to the shape of the user U and overlaying the at least one muscle group of the user U; and 5. deforming the wrap-around exercise garment from its original shape through natural extension and flexing actions of the user to facilitate providing a resistive force to condition or develop the at least one muscle group of the user U; and 6. adjusting on the fly, the resistance level of the first resistance article 12 and or the second resistance article 14 to facilitate the conditioning of the at least one muscle group of the user U.

While this invention has been shown and described with respect to one or more detailed embodiment thereof, it will be understood by those skilled in the art that changes in form and detail thereof may be made without departing from the scope of the claims of the invention. For example, from the above-detailed description, one skilled in the art should understand that the first resistance article 12 and the second resistance article 14 function as an expandable exercise system; that is the exercise kit 6 can be utilized in the following configurations: (1) in a first configuration with adjustable air pressure opposing structures alone as provided by the first resistance article 12, which when mounted by the user U, is transformed from a substantially flat 2-dimensional device as seen in a plane view such as FIG. 6 into a 3-dimensional device as seen in the pictorial view of FIG. 10 for example; (2) in a second configuration with adjustable static opposing structures alone, such as the resistance elements 72-74 and 76-78, as provided by the second resistance article 14, which when mounted by the user U, is transformed from a substantially flat 2-dimensional device as seen in a plane view such as FIG. 6 into a 3-dimensional device as seen in the pictorial view of FIG. 10 for example (in this configuration, the first resistance article 12 remains in a deflated state so that none of the adjustable air pressure opposing structures AC are exerting opposing forces against the selected muscle group or groups of the user U); and (3) in a third configuration where selected ones of the adjustable air pressure opposing structures (AC), cooperated with selected ones of the resistance elements 72-74 and 76-78, so that the first resistance article 12 and the second resistance article 14 cooperate together as an exercise system. As another example, relative to using the exercise kit 6 and more specifically the second article of resistance 14, one or more of the resistance elements 72-74 and 76-78, may be added, deleted or even interchanged while the user is wearing the first article of resistance 12.

PARTS LIST

6 an exercise kit 6
8 a pair of exercise shorts 8
10 an adjustable exercise device 10
12 a first resistance article 12
14 a second resistance article 14
20 a flexible polyvinylchloride (PVC) inside member 20
22 an inside member interior or bonding surface 22
24 die alignment mark
26 die alignment mark
29 a right side group of resistance element covers
30 a flexible polyvinylchloride (PVC) outside member 30
31 a left side group of resistance element covers
32 an outside member interior or bonding surface 32
33 cover 33
34 cover 34
35 cover 35
36 an outside member exterior surface 36
37 cover 37
38 cover 38
39 cover 39
40 an air pressure adjustment mechanism 40
42 an inflatable right side group of air chambers 42
43 air hole
45 air passageway 45
46 air passageway 46
47 air passageway 47
48 air passageway 48
49 air passageway 49
50 an air pressure adjustment mechanism 50
51 a right side inlet
52 an inflatable left side group of air chambers 52
53 a left side inlet
54 a left side air pump or inflating mechanism 54
55 air passageway 55
56 air passageway 56
57 air passageway 57
58 air passageway 58
59 air passageway 59
60 a deflating mechanism 60
61 flexible bulb 61
62 flat body portion 62
63 inflate valve outlet
63' front inflate valve member
63" rear inflate valve member
64' front inflate valve right side cutout
64" rear inflate valve right side cutout
65' front inflate valve left side cutout
65" rear inflate valve left side cutout
66 bulb pump
67 right ear portion
68 upstanding stop
70 a deflating mechanism or release valve 70
72 resistance element 72
73 resistance element 73
74 resistance element 74
75 closure flap 75
76 resistance element 76
77 resistance element 77
78 resistance element 78
80 a waist strap 80
80' an inside member wrist strap portion 80'
80" an outside member wrist strap portion 80"
81 a waist hook pad 81
82 a right leg strap 82
82' an inside right leg strap portion 82'
82" an outside right leg strap portion 82"
83 a right leg hook pad 83
84 a left leg strap 84
84' an inside left leg strap portion 84'
84" an outside left leg strap portion 84"
85 a left leg hook pad 85
86 deflate valve button or plunger 86
87 deflate valve spring 87
88 deflate valve base 88
89 deflate valve base flange 89
90 a waist strap receiving slot 90
90' an inside waist strap receiving slot portion 90'
90" an outside waist strap receiving slot portion 90"
91 a waist pile pad 91
92 a right leg strap receiving slot 92
92' an inside right leg strap receiving slot portion 92'
92" an outside right leg strap receiving slot portion 92"
93 a right leg pile pad 93
94 a left leg strap receiving slot 94
94' an inside right leg strap receiving slot portion 94'
94" an outside left leg strap receiving slot portion 94"
95 a left leg pile pad 95
99 a barrier 99

We claim:

1. A muscle toning kit, comprising:

a first resistance article to facilitate the exercise of at least one muscle group of a user;

said first resistance article having a pressure opposing structure with a range of user selected resistance levels;

wherein the user maneuvers the pressure opposing structure of said first resistance article by exerting an operating pressure thereupon to facilitate conditioning or developing of said at least one muscle group of the user;

a second resistance article configured to cooperate with and overlay said first resistance article to further facilitate the exercise of said at least one muscle group of the user;

said second resistance article having another pressure opposing structure with another range of user selected resistance levels; and wherein the user maneuvers the pressure opposing structure of said second resistance article by exerting an operating pressure thereupon to facilitate conditioning or developing of said at least one muscle group of the user.

2. The muscle toning kit according to claim 1, wherein said first resistance article is a substantially flat, wrap-around foundation article of a desired shape and function to help facilitate the exercise of at least one muscle group of a user.

3. The muscle toning kit according to claim 2, wherein said wrap-around foundation article is an inflatable foundation article.

4. The muscle toning kit according to claim 3, wherein said inflatable foundation article includes a plurality of air chambers in fluid communication with a bulb air pump; said bulb air pump being adapted to fill said plurality of air chambers with a sufficient volume of air to provide said first resistance article with a maximum resistance level when said plurality of air chambers are full and with another sufficient volume of air to provide said first resistance article with a minimum resistance level when said plurality of air chambers are partially full.

5. The muscle toning kit according to claim 4, wherein said bulb air pump includes a control valve to facilitate enabling a user to selectively inflate said first resistance article or selectively deflate said first resistance article.

6. The muscle toning kit according to claim 5, wherein said first resistance article is provided with a muscle wire pocket for receiving therein said second resistance article.

7. The muscle toning kit according to claim 6, wherein said muscle wire pocket includes a closure to substantially prevent said second resistance article from being dislodged from said muscle wire pocket.

8. The muscle toning kit according to claim 7, wherein said second resistance article is an elongated muscle wire.

9. The muscle toning kit according to claim 8, wherein said elongated muscle wire is substantially U-shape to extend longitudinally along both upper legs of a user.

10. The muscle toning kit according to claim 8, wherein said elongated muscle wire is a steel spring.

11. The muscle toning kit according to claim 7, wherein said second resistance article is a resilient memory member selected from a group of shape memory alloys consisting of steel alloys and titanium alloys.

12. The exercise kit according to claim 11, wherein said titanium alloys include: nickel titanium and copper nickel titanium.

13. The muscle toning kit according to claim 1, wherein said first resistance article is a constructed of a flexible fabric material selected from a group of flexible fabric materials consisting of thermoplastic polyurethanes fabric materials, polypropylene fabric materials, polyethylene fabric materials, polyurethane fabric materials and thermoplastic elastomeric fabric materials.

14. An a muscle toning kit, comprising:

a substantially flat, wrap-around foundation article of clothing of a desired shape and function to help facilitate the exercise of at least one muscle group of a user;

said foundation article of clothing having adjustable tensioning means for overlaying said at least one muscle group of the user and for facilitating the applying of a user adjustable compression tension against said at least one muscle group of the user; and said foundation article of clothing further having a plurality of resilient memory members for facilitating the providing of dynamic tensioning and compressing against said at least one muscle group through natural extension and flexing actions of the user.

15. The exercise kit according to claim 14, wherein each individual one of said plurality of resilient memory members is selected from a group of shape memory alloys consisting of steel alloys and titanium alloys.

16. The exercise kit according to claim 15, wherein said titanium alloys include: nickel titanium and copper nickel titanium.

17. The exercise kit according to claim 14, wherein said adjustable tensioning means overlays said at least one muscle group laterally.

18. The exercise kit according to claim 17, wherein said plurality of resilient memory members overlay said at least one muscle group longitudinally.

19. The exercise kit according to claim 18, wherein said adjustable tensioning means and said plurality of resilient memory members cooperate to provide 360 degrees of opposing force against said at least one muscle group to substantially condition said at least one muscle group by the natural extension and flexing actions of the user.

20. The muscle toning kit according to claim 14, wherein said foundation article of clothing is constructed of a fabric selected from a group of fabrics consisting of thermoplastic polyurethane fabrics, polypropylene fabrics, polyethylene fabrics, polyurethane fabrics, and thermoplastic elastomeric fabrics.

21. The muscle toning kit according to claim 14, wherein said plurality of resilient memory members are heat sealed to said foundation article of clothing.

22. The muscle toning kit according to claim 21, wherein each individual resilient memory member of said plurality of resilient memory members is a substantially flat resilient memory member.

23. The muscle toning kit according to claim 21, wherein each individual resilient memory member deforms at or about the body temperature of a user to provide dynamic tensioning and compressing when said foundation article of clothing is deformed from an original shape through natural extension and flexing actions of the user wearing the foundation article.

24. A method of exercising, comprising the steps of:

providing a substantially flat wrap-around exercise garment adapted to be worn over an article of clothing worn by a user, said exercise garment having a desired shape and function to help facilitate the exercise of at least one muscle group of the user;

said exercise garment including: a first resistance article to facilitate the exercise of at least one muscle group of the user;

said first resistance article having a pressure opposing structure with a range of user selected resistance levels wherein the user maneuvers the pressure opposing structure of said first resistance article by exerting an operating pressure thereupon to facilitate conditioning or developing of said at least one muscle group of the user;

a second resistance article configured to cooperate with and overlay said first resistance article to further facilitate the exercise of said at least one muscle group of the user;

said second resistance article having another pressure opposing structure with another range of user selected resistance levels wherein the user maneuvers the pressure opposing structure of said second resistance article by exerting an operating pressure thereupon to facilitate conditioning or developing of said at least one muscle group of the user; and wearing said wrap-around exercise garment; and deforming said wrap-around exercise garment from its original shape through natural extension and flexing actions of the user to facilitate providing a resistive force to condition or develop said at least one muscle group of the user.

25. The method of exercising according to claim 24, further including the steps of:

selecting a second resistance article having a sufficient resistance level to facilitate the conditioning of said at least one muscle group of the user; and adjusting on the fly, the resistance level of said first resistance article to facilitate the conditioning of said at least one muscle group of the user.

* * * * *